United States Patent [19]

Christian

[11] 4,239,163

[45] Dec. 16, 1980

[54] ROLL HOLDER FRICTION BRAKE

[76] Inventor: Glen H. Christian, 901 S. Sarnoff Dr., Tucson, Ariz. 85710

[21] Appl. No.: 113,593

[22] Filed: Jan. 21, 1980

[51] Int. Cl.[3] ..... B65H 19/00

[52] U.S. Cl. ..... 242/55.2

[58] Field of Search ..... 242/55.2, 55.3, 55.53

[56] References Cited

U.S. PATENT DOCUMENTS

| | | | |
|---|---|---|---|
| 551,040 | 12/1895 | Morgan | 242/55.2 |
| 2,562,923 | 8/1951 | Kolivoski | 242/55.2 |
| 3,170,652 | 2/1965 | Kennedy | 242/55.2 |
| 3,770,221 | 11/1971 | Stern | 242/55.2 |
| 3,850,379 | 11/1974 | Stern | 242/55.2 |

*Primary Examiner*—Edward J. McCarthy

*Attorney, Agent, or Firm*—Cahill, Sutton & Thomas

[57] ABSTRACT

A tissue roll holder includes a brake member insertable to fit snuggly into an open end of a cardboard tube on which a roll of tissue is wound before the roll of tissue is mounted on the roll holder. A spring loaded support spindle urges a base plate of the brake member against an arm of the roll holder, producing a frictional force which prevents free rotation of the roll of tissue.

10 Claims, 4 Drawing Figures

ROLL HOLDER FRICTION BRAKE

BACKGROUND OF THE INVENTION

1. Field of the Invention

The invention relates to roll holders, and more particularly to roll holders including friction brake mechanisms to prevent free rotation of tissue rolls.

2. Description of the Prior Art

A variety of roll holders which include brake devices have been proposed for preventing paper rolls, such as toilet tissue rolls, from rotating freely and unwinding excessive amounts of paper or toilet tissue. The problem of excessive unwinding of toilet tissue is frequently vexing and expensive, especially in public buildings, hotels, motels, and the like. Patrons of such establishments often carelessly tug unnecessarily forcefully on the free end of a tissue paper roll, dispensing far more tissue than is necessary. The extra tissue frequently clutters up the bathroom facilities of public buildings, increasing janitorial costs and unnecessarily wasting tissue paper. None of the devices proposed for overcoming this problem have yet found widespread acceptance because they are unsatisfactory for a variety of reasons. For example, U.S. Pat. No. 3,850,379 discloses a tissue holder brake mechanism including a spring member which is inserted into one end of a tissue roll. The spring member has a U-shaped cross sectional configuration which exerts opposed forces against the tissue roll and a roll holder arm, producing a frictional braking action on the tissue roll. However, the device disclosed in U.S. Pat. No. 3,850,379 is unsuitable for use with most commercially available roll holders, especially roll holders of the recessed type, which often have only approximately an eighth to a quarter of an inch space between the end of the tissue roll and the roll holder arm. Further, the device of U.S. Pat. No. 3,850,379 tends to force the opposite end of the tissue roll against the opposite roll holder arm, thereby tending to fray the tissue.

Accordingly, it is an object of the invention to provide a roll holder brake which is useable in conjunction with most commonly available roll supports, including preinstalled roll supports of the recessed type.

Another object of the invention is to provide a brake system which avoids fraying of paper or tissue on the supported roll.

A novelty search directed to the present invention uncovered the following U.S. Pat. Nos. 1,618,342; 2,699,903; 2,749,056; 2,889,122; 3,318,543; 3,770,221; 3,918,661; 4,149,680 and 551,040. The brake schemes disclosed in the above patents suffer from a variety of shortcomings, including the shortcomings of being unduly complex and expensive; of being unsuitable for use with conventional roll holders, and of causing damage to the rolls of paper or tissue. Accordingly, it is another object of the invention to provide a paper roll holder brake device which avoids the various shortcomings of the above references.

SUMMARY OF THE INVENTION

Briefly described, and in accordance with one embodiment thereof, the invention provides a roll holder for tissue rolls which roll holder includes a telescopic roll support spindle assembly having first and second telescoping sections spring biased outwardly with respect to each other. First and second bearing ends are attached to opposed ends of the first and second telescoping portions, the bearing ends having diameters smaller than the respective diameters of the first and second telescoping sections of the roll support spindle. The brake mechanism includes a base plate having a circular hole therein of a diameter slightly larger than the diameter of the bearing section. A roll-engaging section is attached to the base plate and extends from a first major surface of the base plate. The roll-engaging section includes a plurality of members which press outwardly to snuggly engage the inner surface of a core on which the roll of tissue is wound. The brake member is inserted into one end of the tissue roll before the tissue roll is mounted on the roll holder. The first bearing end is inserted through the circular hole from the first side of the base plate. The first and second spindle sections are telescopically pressed together, enabling the first and second bearing sections to be inserted into receiving holes in first and second arms of the tissue holder. An internal spring which biases the first and second telescoping sections outward presses the second surface of the base plates against the second arm of the tissue holder, producing a friction braking force which prevents free rotation of the tissue roll.

DESCRIPTION OF THE INVENTION

Figure 1:
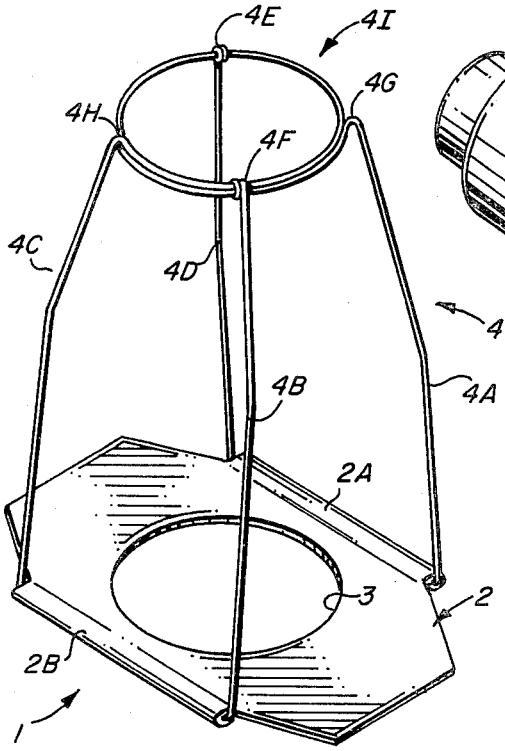
FIG. 1 is a perspective view of a brake member according to the present invention.

Referring now to the drawings and particularly to FIG. 1, brake device 1 includes a metal base plate 2. Base plate 2 includes a circular hole 3 centrally disposed therein. A pair of opposed edges of base plate 2 are folded upward to form retaining flanges 2A and 2B.

Retaining flanges 2A and 2B engage wire core-engaging members 4A, 4B, 4C and 4D to attach them to base plate 2. Each of members 4A, 4B, 4C, and 4D, are curved so as to bow outward, enabling them to snuggly engage the inner surface of a core 20 of a roll 18 of toilet tissue, as shown in FIG. 3.

Reference numeral 4I designates a circular wire hoop which supports the free ends of legs 4A, 4B, 4C, and 4D. Members 4A, 4B, 4C, and 4D and loop 4I are all formed from a single piece of steel spring wire of suitable thickness and strength. The wire is bent to provide the core-engaging configuration and hoop configuration shown in the drawings. The first end of the piece of wire is bent as indicated by reference numeral 4E to engage a first point of loop 4I. The piece of wire is bent to bow slightly outward, forming member 4D, and includes a section which extends beneath flange 2A to the base of member 4A. The piece of wire is then bent at a location indicated by reference numeral 4G and continues in a circular path thereby forming loop 4I. The wire continues, overlapping itself, to another point designated by reference numeral 4H. At point 4H, the wire is bent downward to form member 4C, and extends beneath flange 2B and upward to form member 4B. The second end of the piece of wire is bent to engage another point (opposite to the first end) of hoop 4I, as indicated by reference numeral 4F. The four lower ends of members 4A, 4B, 4C and 4D lie on the corners of an imaginary square; the upper ends of the four core-engaging members lie on the corners of a smaller imaginary square.

Figure 3:
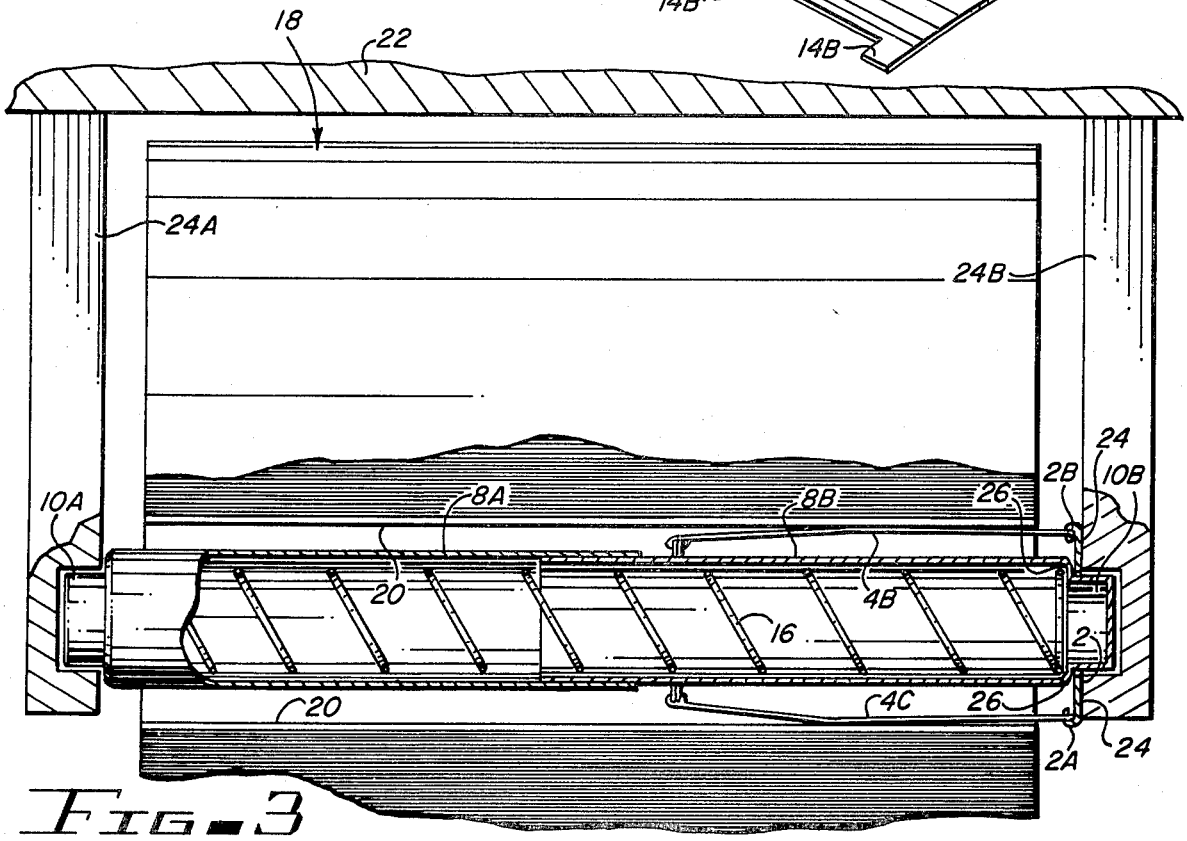
FIG. 3 is a partial cut-away top view useful in explaining the operation of the device of FIG. 1.

In use, brake device 1 is inserted into an open end of core 20 about which tissue roll 18 is wound before the tissue roll is installed in a roll holder, which roll holder includes arms 24A and 24B (FIG. 3). Members 4A, 4B, 4C, and 4D are bowed outward by an amount sufficient to snuggly engage the inner wall of core 20, thereby causing braking device 1 to rotate at the same rate (without slippage) that tissue roll 18 rotates when it is installed in the roll holder.

Figure 2:
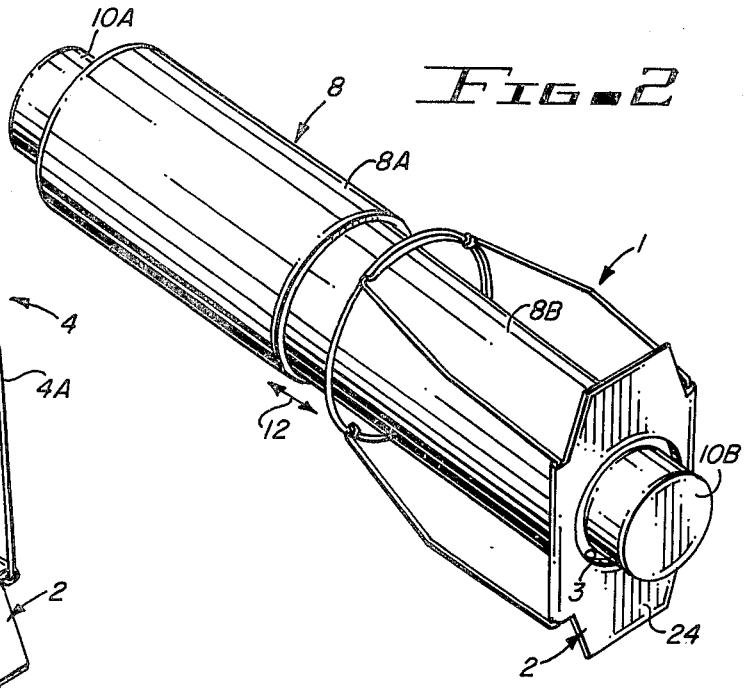
FIG. 2 is a perspective view illustrating the use of the device of FIG. 1.

Next, a conventional spindle assembly 8 is inserted through hoop 4I. Spindle assembly 8 includes an outer telescoping section 8A and an inner telescoping section 8B. A first cylindrical bearing end 10B is attached to the free end of inner telescoping section 8B, and a second cylindrical bearing end 10A is attached to the free end of outer telescoping section 8A, as shown in FIG. 2. The diameter of cylindrical bearing end 10B is slightly less than the diameter of hole 3 in base plate 2, so that bearing end 10B can freely extend through hole 3. However, the diameter of inner telescoping section 8B is substantially greater than the diameter of hole 3 of the base plate 2, so that the end of telescoping section 8B can not pass through hole 3 and consequently presses against the portion of base plate 2 surrounding hole 3 when brake device 3 is properly installed.

As seen in FIG. 3, spindle assembly 8 includes a compressed coil spring 16 which forces or spring biases telescoping sections 8A and 8D outward with respect with each other, thereby forcing bearing ends 10A and 10B into receiving holes in the respective end portions of roll holder arms 24A and 24B, as shown in FIG. 3. FIG. 2 illustrates the relationship of braking device 2 to spindle assembly 8.

Thus, it is seen that tissue roll 18 does not rotate freely about spindle assembly 8A because inner telescoping section 8B forces the outer or lower face of base plate 2 against the inner face of roll holder arm 24B. More specifically, shoulder or end 26 (FIG. 3) of inner telescoping section 8B presses against the periphery of hole 3 (FIG. 1), pushing base plate 2 against the inner surface of roll holder arm 24B.

When tissue roll 18 rotates, (as a user unwinds a suitable length of tissue therefrom), brake device 2 also rotates, and lower surface 24 of base plate 2 frictionally engages the inner surface of roll holder arm 24B, thereby tending to resist the rotation of tissue roll 18.

Figure 4:
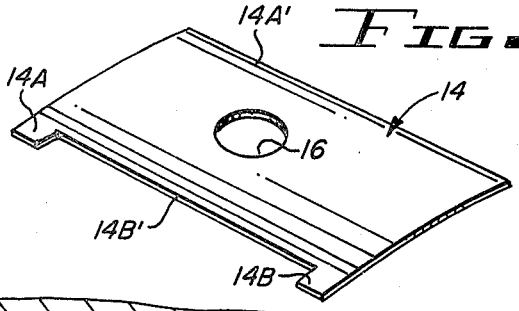
FIG. 4 is an adapter plate which can be utilized in conjunction with the device of FIG. 1.

Adapter plate 14, shown in FIG. 4, can be attached to base plate 2 in order to enable brake device 1 to be utilized in conjunction with a spindle assembly having a smaller telescoping section diameter than telescoping section 8B shown in FIGS. 2 and 3. Adapter plate 14 has a small diameter hole 16 centrally disposed therein. The diameter of hole 16 can be selected to suitably accomodate any telescoping section having a diameter smaller than hole 3 of base plate 2. Edge 14A of adapter plate 14 can be slid beneath flange 2A and edge 14B can be slid beneath flange 2B to fasten adapter plate 14 to base plate 2.

Tabs 14A and 14B are spaced by a distance approximately equal to the spacing between the lower ends of members 4A and 4C, and perform the function of aligning adapter plate 14 so that hole 16 is concentric with hole 3 of base plate 2.

Adapter plate 14 also can be utilized in conjunction with a commonly used roll support which does not utilize a telescoping roll support spindle, but instead has a pair of core-engaging pins or pegs integral with or attached to the roll holder arms. The core-engaging pins or pegs extend into the open ends of the core 20 of the tissue roll. The support arms are sufficiently resilient that they can be sprung apart to allow installation of a new tissue roll or removal of an old core. The diameter of hole 16 of adapter plate 14 can be selected to effect smooth rotation of the tissue roll when it is installed in the later type of roll support.

Brake device 1 provides a very inexpensive device which can be utilized with most conventional tissue roll holders. The described brake device provides a braking force which is sufficient to prevent excessive unwinding of toilet tissue due to free spinning of the tissue roll and yet allows the user to unwind a desired length of tissue without accidentally tearing the tissue before the desired length is unwound.

Although commonly available tissue rolls have cores with inside diameters varying from approximately $1\frac{1}{2}$ to 2 inches, the configuration of resilient core-engaging members 4A, 4B, 4C, and 4D allows brake device 1 to properly prictionally engage the inner surfaces of all such cores.

While the invention has been described with reference to a particular embodiment thereof, those skilled in the art will be able to make various modifications to the disclosed structure without departing from the true spirit and scope of the invention, as set forth in the appended claims. For example, base plate 2 can be made of a durable plastic material, the members 4A-4E could be made of other material than wire. Plastic core-engaging members could be integrally formed with a plastic base plate.

I claim:

1. A brake device for a paper roll holder, the roll holder including (i) a spindle assembly including first and second telescoping sections, the first and second telescoping sections being cylindrical and aligned along a first axis, the first telescoping section, having a first diameter, the first and second telescoping sections being biased outwardly from each other along the first axis, (ii) a spindle support, and (iii) first and second bearing ends for engaging the spindle support, the first and second bearing ends being attached, respectively, to the free ends of the first and second telescoping sections, the first and second bearing ends being aligned with the first axis, the first bearing means having a second diameter, the second diameter being less than the first diameter, said brake device comprising in combination:

a. base plate means for frictionally engaging a first portion of the spindle support to tend to resist rotation of the paper roll, said base plate means having a hole therein, said hole having a third diameter which is less than the first diameter and greater than the second diameter, the first bearing end passing through said hole, said base plate means having first and second opposed faces, a portion of the first face frictionally engaging the first portion of the spindle support; and b. core-engaging means attached to the second face of said base plate means for snuggly engaging the inner surface of a core on which the paper roll is wound to cause said base plate means to rotate with the paper roll, the spring bias causing the first telescoping section to press the first surface of said base plate means, causing a second portion of the second face of said base plate means to be pressed against the first portion of the spindle support to effect said frictional engaging, whereby said brake device slows free rotation of the paper roll, preventing excessive unwinding of the paper roll.

2. The brake device of claim 1 wherein said base plate means includes a flat piece of metal.

3. The brake device of claim 2 wherein said core-engaging means includes a plurality of members each having a first end attached to said flat piece of metal, said plurality of members each pressing outwardly with respect to the first axis against the inner wall of the core of the paper roll to snuggly engage the inner wall of the core.

4. The brake device of claim 3 wherein said core-engaging means includes a circular means attached to a second end of each of said members to support the respective second ends of each of said members.

5. The brake device of claim 4 wherein said members and said circular means are composed of a single piece of metal wire curved to form said circular means and said members.

6. The brake device of claim 5 further including first and second flanges on opposed edges of said flat piece of metal for fastening said members to said flat piece of metal.

7. The brake device of claim 5 wherein said plurality of members include first, second, third and fourth members attached to said base plate means at first, second, third and fourth points of said base plate means, said first, second, third and fourth points lying, respectively, on the respective corners of an imaginary square, the second end of said first member being located at a second end of said first member, the second end of said wire being located at the second end of said third member, said circular means being a loop formed by a portion of said piece of wire, the loop having a diameter larger than said second diameter.

8. The brake device of claim 6 further including an adapter plate, said adapter plate having opposed edges which can be attached to said base plate means, said adapter plate having a hole smaller than the hole in said base plate means in order to enable said brake device to be utilized in conjunction with a roll holder with a first telescopic end having a diameter smaller than said third diameter, but larger than a diameter of the hole in said adapter plate.

9. The brake device of claim 8 wherein said adapter plate has a pair of opposed edges which engage said flanges of said base plate to attach said adapter plate to said base plate.

10. The brake device of claim 6 further including an adapter plate, said adapter plating having opposed edges which can be attached to said base plate means to enable said brake device to be utilized in conjunction with a roll holder which does not have a telescoping spindle assembly and does have a piece of core-engaging pins for extending into opposite ends, respectively, of the core to rotatably support the paper roll, said adapter plate having a hole therein slightly larger than the diameter of one of the core-engaging pins.

* * * * *